US007341003B2

(12) United States Patent
Wanninger

(10) Patent No.: US 7,341,003 B2
(45) Date of Patent: Mar. 11, 2008

(54) COMBUSTIBLE PROPELLANT CHARGE CASING

(75) Inventor: Paul Wanninger, Hermannsburg (DE)

(73) Assignee: Rheinmetall Waffe Munition GmbH, Ratingen (DE)

( * ) Notice: Subject to any disclaimer, the term of this patent is extended or adjusted under 35 U.S.C. 154(b) by 287 days.

(21) Appl. No.: 11/227,959

(22) Filed: Sep. 15, 2005

(65) Prior Publication Data

US 2007/0277694 A1 Dec. 6, 2007

(30) Foreign Application Priority Data

Sep. 15, 2004 (DE) ..... 10 2004 044 634

(51) Int. Cl.
*F42B 5/192* (2006.01)

(52) U.S. Cl. ..... 102/431

(58) Field of Classification Search ..... 102/431, 102/432, 433, 435, 465
See application file for complete search history.

(56) References Cited

U.S. PATENT DOCUMENTS

| | | | | |
|---|---|---|---|---|
| H18 | H * | 2/1986 | Bracuti et al. | 102/435 |
| 5,544,587 | A * | 8/1996 | Thiesen et al. | 102/431 |
| 2002/0121212 | A1 * | 9/2002 | Wanninger et al. | 102/435 |

* cited by examiner

*Primary Examiner*—Stephen M Johnson
(74) *Attorney, Agent, or Firm*—Klaus P. Stoffel; Wolff & Samson PC

(57) ABSTRACT

A combustible propellant charge casing for ammunition which can be shot from the barrel of a weapon. So that the erosion-reducing additive will lead to a decrease in the erosive action of the propellant powder present in the molded part of the ammunition better than that of known additives, either polyacetylene or a mixture of $WO_3$ and $MoO_3$ and $CeO_2$ or $La_2O_3$ or $Y_2O_3$ is used as the erosion-reducing additive. The particle size of the erosion-reducing additive does not exceed 30 μm, and the specific surface area of the erosion-reducing additive is at least 2 $m^2/g$. The mixture can also contain polyoxymethylene (POM).

6 Claims, 1 Drawing Sheet

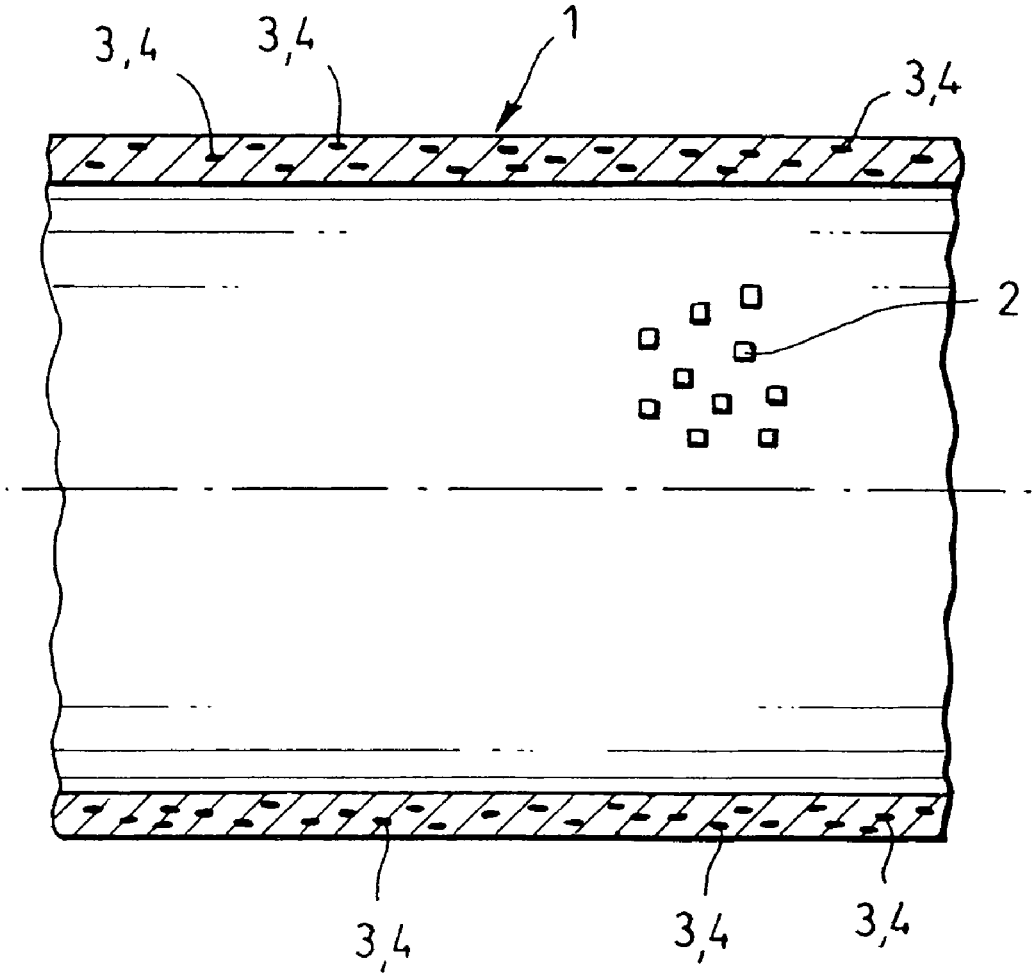
3,4
3,4
1
3,4
2
3,4
3,4
3,4

COMBUSTIBLE PROPELLANT CHARGE CASING

BACKGROUND OF THE INVENTION

The invention pertains to a combustible propellant charge casing for ammunition which can be shot from the barrel of a weapon.

High-energy propellant powder such as that required for shooting performance-enhanced projectiles produces high temperatures and pressures in the weapon barrel in question and thus also leads to increased wear of the barrel through erosion. To reduce this type of erosion, it is known that talc, wax, or a similar material can be mixed into the propellant powder. It has been found, however, that the erosion-reducing effect of such additives is relatively weak.

From DE 39 27 400 A1, furthermore, it is known that wax or paraffin as erosion-reducing material can be mixed not with the propellant powder but rather with the molded part of the ammunition consisting of a combustible plastic shrink film. A significant reduction in the erosive action of the propellant gases on the inside wall of the weapon barrel in question has not been achieved in this case either.

It is known from U.S. Pat. No. 3,403,625 and U.S. Pat. No. 3,426,684 that $WO_3$ or $MoO_3$ can be added as erosion-reducing additives to the propellant powder. When the cartridges in question are fired, a protective layer which has the effect of reducing the erosive action of the propellant gases is said to form on the inside wall of the weapon barrel. It is also mentioned in these publications that, in the case of cartridges with combustible propellant casings, the erosion-reducing additives can also be introduced into the propellant casing. Detailed information on the specific composition of the substances to be introduced into the propellant casing, however, cannot be extracted from these publications.

Finally, a combustible propellant charge casing is disclosed in DE 101 03 912 A1 filed by the applicant, in which an oxide of one of the rare earth elements, especially $La_2O_3$, $CeO_2$, or $Y_2O_3$ or one of the elements of the 6th subgroup of the periodic system, especially $MoO_3$ or $WO_3$, or polyoxymethylene (POM), or a combination of these substances is used as an erosion-reducing substance. The amount of erosion-reducing additive in the propellant casing should be in the range of 2-15 wt. %.

As the applicant has discovered, the surprisingly good erosion-reducing action of the oxides introduced into the propellant charge casing is not attributable to, for example, the formation of a protective layer on the inside wall of the weapon barrel but rather on the reduction of the atomic hydrogen molecules produced during the combustion of the propellant powder (atomic hydrogen attacks the grain boundaries of the chromium layer and of the steel, loosens the microstructure, and leads to the break-out of individual grains and thus to erosion). The atomic hydrogen which forms at high temperatures releases energy (432 kJ/mole) as it forms hydrogen molecules, and this reaction normally contributes significantly to the heating of the inside wall of the barrel ($2(H) \rightarrow H_2 + 432$ kJ). With the trioxides of tungsten and molybdenum, however, hydrogen reacts exothermically at temperatures above 800° C. and 1,000° C., respectively, as follows:

$$WO_3 + 6\langle H\rangle \rightarrow W + 3H_2O + 14 \text{ kJ (at 800° C.)}$$

$$MoO_3 + 6\langle H\rangle \rightarrow Mo + 3H_2O + 14 \text{ kJ (at 1,000° C.)}.$$

Finely distributed $WO_3$ or $MoO_3$ in the combustible casing reaches temperatures of more than 1,000° C. when the powder burns and thus reacts completely with both atomic and molecular hydrogen.

In the reaction of atomic hydrogen, the enthalpy of the formation of molecular hydrogen is 432 kJ/mole. After subtraction of the exothermic enthalpy of the reduction of $WO_3$, an enthalpy reduction of about 426 kJ/mole is obtained, where one mole of $WO_3$ reduces 3 moles of $H_2$.

When $MoO_3$ is used, the enthalpy is reduced by about 395 kJ/mole. As a result of the reduction of the oxidizing agents $WO_3$ and/or $MoO_3$, some of the atomic hydrogen formed during combustion of the powder is consumed and thus cools the gas formed by the powder on the inside barrel wall and the inside barrel wall itself. The resulting additional water vapor from the reaction of $WO_3$ and/or $MoO_3$ produces a cooling pipe flow along the inside wall of the barrel.

Additional reaction partners for hydrogen are the oxides of bismuth, manganese, and yttrium and especially $La_2O_3$ and $CeO_2$ as well as organic compounds which easily break down into small radicals and trap the atomic hydrogen immediately. Thus, energy is consumed when polyoxymethylene (POM) decomposes into $CH_2$—O radicals.

SUMMARY OF THE INVENTION

Accordingly, it is an object of the present invention to provide a combustible propellant charge casing which contains erosion-reducing additives which results in even better reduction of the erosive action of the propellant powder on the inside surface of a weapon barrel than known, comparable additives are able to achieve.

Pursuant to this object, one aspect of the present invention resides in a combustible propellant charge casing that contains an erosion-reducing additive in a proportion of between 2 and 15 wt. % based on the weight of the propellant casing. The erosion-reducing additive consists of polyacetylene or a mixture of $WO_3$ or $MoO_3$ and $CeO_2$ or $La_2O_3$ or $Y_2O_3$. The particle size of the erosion-reducing additive does not exceed 30 μm, and the specific surface area of the erosion-reducing additive is at least 2 $m^2/g$. The mixture can also contain polyoxymethylene (POM).

The erosion-reducing additive can consist of a mixture of 2-5% of POM, 2-10% of $WO_3$ or $MoO_3$, and 2-5% of $CeO_2$ or $La_2O_3$. It has been found especially advantageous for the erosion-reducing additive to comprise a mixture of 3% of POM, 8% of $WO_3$ or $MoO_3$, and 2% of $CeO_2$ or $La_2O_3$.

In another mixture with good erosion-reducing action, the additive consists of a mixture of 6-8% of $WO_3$ and 2% of $CeO_2$.

The particle size of the erosion-reducing additive should preferably be in the range of 1-10 μm.

When polyacetylene, which reacts readily with hydrogen, is used, the resulting ethylene and ethane, like the $H_2O$ and $CH_3OH$, create a pipe flow, which cools the inside wall of the barrel.

Additional details and advantages of the invention can be derived from the following exemplary embodiment, which is explained on the basis of a figure.

BRIEF DESCRIPTION OF THE DRAWINGS

The figure shows a section of a combustible propellant charge casing for ammunition which can be shot from the barrel of a weapon (not shown).

DETAILED DESCRIPTION OF THE INVENTION

The propellant charge casing is designated 1, and the propellant powder (indicated only schematically) inside the propellant casing 1 is designated 2.

According to the invention, the propellant casing 1 contains an erosion-reducing additive 4 consisting of a plurality of particles 3. Based on the weight of the propellant casing, this additive consists of a mixture of, for example, 6-8% of $WO_3$ and 2% of $CeO_2$.

For the production of the inventive propellant casing 1, 3-12 wt. % of the erosion-reducing additive is added to an aqueous slurry (pulp) of cellulose, nitrocellulose, and a binder. The $WO_3$ and $CeO_2$ particles partially dissolve in the pulp and recrystallize. Thus even finer particles 3 precipitate from the fine particles. The finer particles should have an average size of preferably 1-10 μm, and their specific surface area should be at least 2 $m^2/g$.

Then the propellant casing can then be produced in the conventional manner (e.g., by shaping it on a forming mandrel).

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements which perform the same function in substantially the same way to achieve the same result are within the scope of the invention. Substitutions of elements from one described embodiment to another are also fully intended and contemplated. It is also to be understood that the drawings are not necessarily drawn to scale but that they are merely conceptual in nature.

I claim:

1. A combustible propellant charge casing for ammunition which can be shot from a barrel of a weapon, comprising:

(a) a propellant casing that contains an erosion-reducing additive in a proportion of between 2 and 15 wt. % based on the weight of the propellant casing;

(b) the erosion-reducing additive is either polyacetylene or a mixture of $WO_3$ or $MoO_3$ and $CeO_2$ or $La_2O_3$ or $Y_2O_3$;

(c) particles of the erosion-reducing additive have a size that does not exceed 30 μm; and (d) a specific surface area of the erosion-reducing additive is at least 2 $m^2/g$.

2. The combustible casing according to claim 1, wherein the erosion-reducing additive also contains polyoxymethylene (POM).

3. The combustible casing according to claim 2, wherein the erosion-reducing additive is a mixture of 2-5% of POM, 2-10% of $WO_3$ or $MoO_3$, and 2-5% of $CeO_2$ or $La_2O_3$.

4. The combustible casing according to claim 3, wherein the erosion-reducing additive is a mixture of 3% of POM, 8% of $WO_3$ or $MoO_3$, and 2% of $CeO_2$ or $La_2O_3$.

5. The combustible casing according to claim 1, wherein the erosion-reducing additive is a mixture of 6-8% of $WO_3$ and 2% of $CeO_2$.

6. The combustible casing according to claim 1, wherein an average size of the particles of the erosion-reducing additive is in a range of 1-10 μm.

* * * * *